United States Patent [19]

Su

[11] Patent Number: 4,821,928

[45] Date of Patent: Apr. 18, 1989

[54] MOVEABLE VALVE STRUCTURE FOR PERFUME ATOMIZERS

[76] Inventor: Cheng Y. Su, No. 1186, Tung Ta Road, Hsinchu, Taiwan

[21] Appl. No.: 101,869

[22] Filed: Sep. 25, 1987

[51] Int. Cl.[4] ..... B67D 5/42

[52] U.S. Cl. ..... 222/321; 222/385; 239/333

[58] Field of Search ..... 222/321, 335, 380, 385; 239/333, 343

[56] References Cited

U.S. PATENT DOCUMENTS

| | | | |
|---|---|---|---|
| 4,025,046 | 5/1977 | Boris | 239/333 |
| 4,277,001 | 7/1981 | Nozawa | 239/333 X |
| 4,305,530 | 12/1981 | Nozawa | 239/333 X |
| 4,369,900 | 1/1983 | Saito et al. | 222/321 |
| 4,462,549 | 7/1984 | Saito et al. | 239/333 |
| 4,606,479 | 8/1986 | Van Brocklin | 239/333 X |

*Primary Examiner*—Joseph J. Rolla

*Attorney, Agent, or Firm*—Leonard Bloom

[57] ABSTRACT

The instant moveable valve assembly mainly comprises a piston body and a moveable valve body associated with the piston body. The moveable valve has at its middle portion a sleeve which is provided with a flattened shoulder. The outer edge of the flattened shoulder is formed with a projection while the lower end of the sleeve is furnished with an outward projection having an inverted triangular shape. In use, the pressure generated by the pressurized liquid perfume in a perfume bottle can be efficiently applied to the flattened shoulder and the outward projection of the sleeve in order to facilitate the downward movement of the sleeve.

3 Claims, 3 Drawing Sheets

MOVEABLE VALVE STRUCTURE FOR PERFUME ATOMIZERS

BACKGROUND OF THE INVENTION

The present invention relates to an improved moveable valve structure for perfume atomizers and particularly to one which can be actuated by a rather slight downward pressure.

Referring to FIG. 1 which is a partial longitudinal cross-sectional view of a perfume bottle of U.S. Pat. No. 4,025,046. The perfume bottle mainly comprises a hollow piston (1) in which a valve member (2) is disposed. The valve member (2) includes a rod (20) and a sleeve (21) wherein the upper half (201) of the rod (20) is received in the hollow piston (1) while the lower half (202) thereof is associated with a spring (3) and is located in a valve seat (4). The sleeve (21) is provided at its lower end with an inward projection (210). In operation, firstly press an atomizer head (5) downward which in turn may drive the hollow piston (1) together with the rod (20) downward such that the sleeve (21) can move downward along the outer wall (40) of the valve seat (4).

By the fluidtight contact between the projection (210) of the sleeve (21) and the outer wall (40) of the valve seat (4), the communication between the inside and the outside of the valve seat (4) is terminated. At the instant, the piston (1) continuously moves downward thereby the liquid perfume contained in the outside of the valve seat (4) is compressed and the pressure generated by the pressurized liquid can only be applied to the shoulder (211) of the sleeve (21). As soon as the liquid pressure overcomes the compression force provided by the spring (3), the sleeve (21) will be forced downward to disengage a valve (203) from a top opening (10) of the hollow piston (1) so that the liquid perfume can be sprayed out from the perfume bottle through the top opening (10) and a nozzle (not shown) of the atomizer head (5). After the liquid perfume contained in the outside of the valve seat (4) is sprayed out from the perfume bottle, the pressure therein is reduced so that the spring (3) will force the valve member (2) upward to its orginal position and meanwhile the liquid perfume contained in the lower storage chamber thereof will be sucked into valve seat (4) for the user's ready use.

However, the disadvantage of the aforesaid structure is that the user has to heavily press the atomizer head (5) downward to actuate the valve member (2) because the shoulder (211) of the sleeve (21) of the valve member (2) fails to respond to the incrasing liquid pressure promptly.

It is, therefore, an object of the present invention to obviate the mitigate the above-mentioned drawback.

SUMMARY OF THE INVENTION

It is the primary object of the present invention to provide an improved moveable valve structure for perfume atomizers wherein a moveable valve can be easily actuated by slightly forcing an atomizer head downward.

It is another object of the present invention to provide an improved moveable valve structure for perfume atomizers which is practical for use.

DETAILED DESCRIPTION OF THE PREFERRED EMBODIMENT

Figure 1:
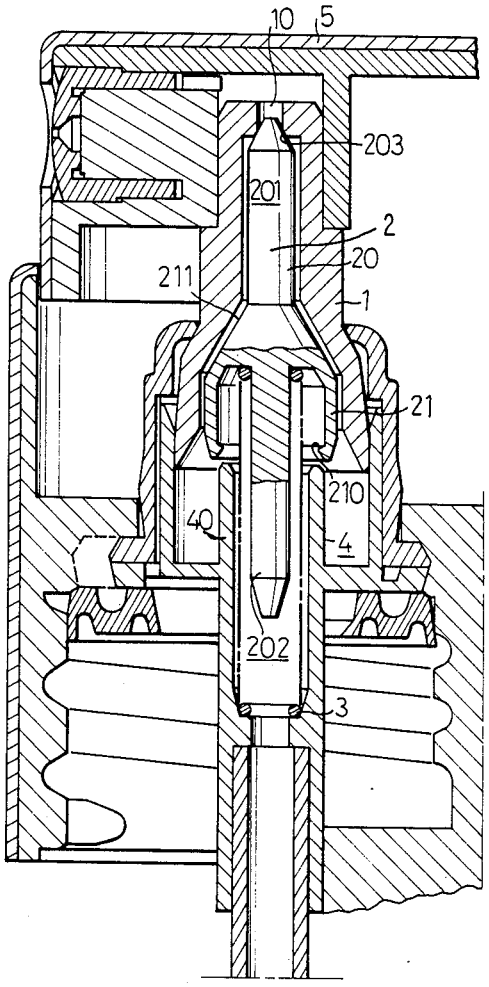
FIG. 1 PRIOR ART
FIG. 1 is a partial longitudinal cross-sectional view of a conventional perfume bottle structure.

Referring to FIG. 1, the sleeve (21) of the conventional structure has a tapered shoulder (211) so that when the high pressure liquid prefume is applied to said tapered shoulder (211), the vertical downward force thus obtained is quite small. Therefore, the sleeve (211) will not be forced downward until the pressure provided by the pressurized liquid is increased to a predetermined level which normally is quite high.

Figure 2:
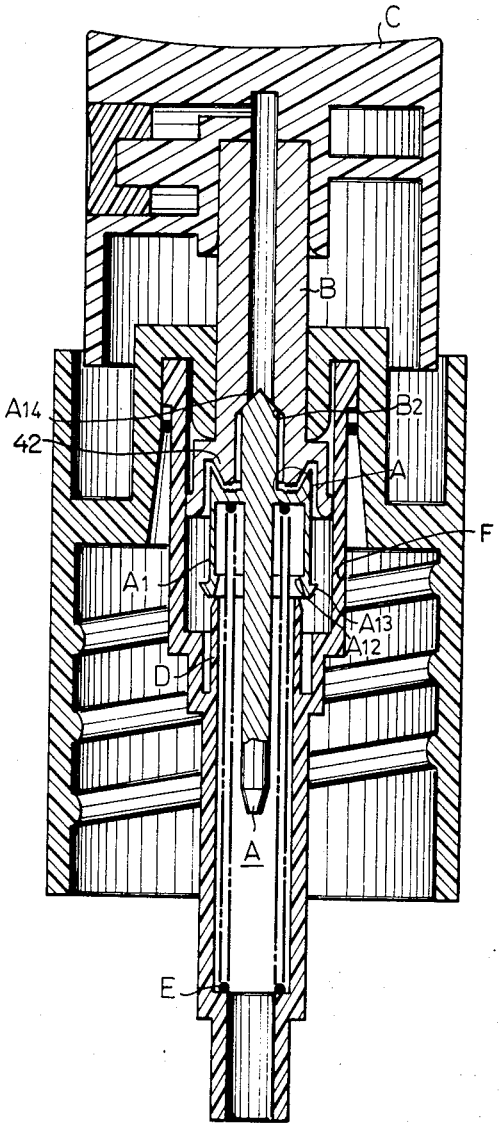
FIG. 2 is a partial longitudinal cross-sectional view of a preferred embodiment of the present invention.
Figure 2A:
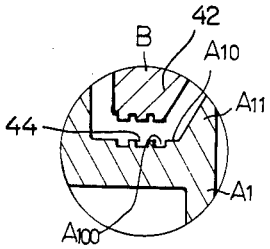
FIG. 2A is an enlarged detail of the protruding ribs and recesses.

Referring to FIG. 2, a preferred embodiment of the valve assembly of the present invention mainly comprises a piston body (B) and a moveable valve (A). The shoulder (A10) of the middle portion (namely the sleeve) (A1) of the moveable valve body (A) is flattened in such a manner that the outer edge of the flattened shoulder (A10) is formed with a projection (A11). The sleeve (A1) is provided at its lower end with an out projection (A13) having an inverted triangular shape which is opposed to an inner projection (A12). The flattened shoulder (A10) of the sleeve (A1) is furnished with a plurality of recesses (A100) or protruding ribs 44. The piston body (B) is provided with a U-shaped lip portion 42 having a plurality of protruding ribs (B1) which respectively correspond to the recesses (A100) of the shoulder (A10).

Figure 3:
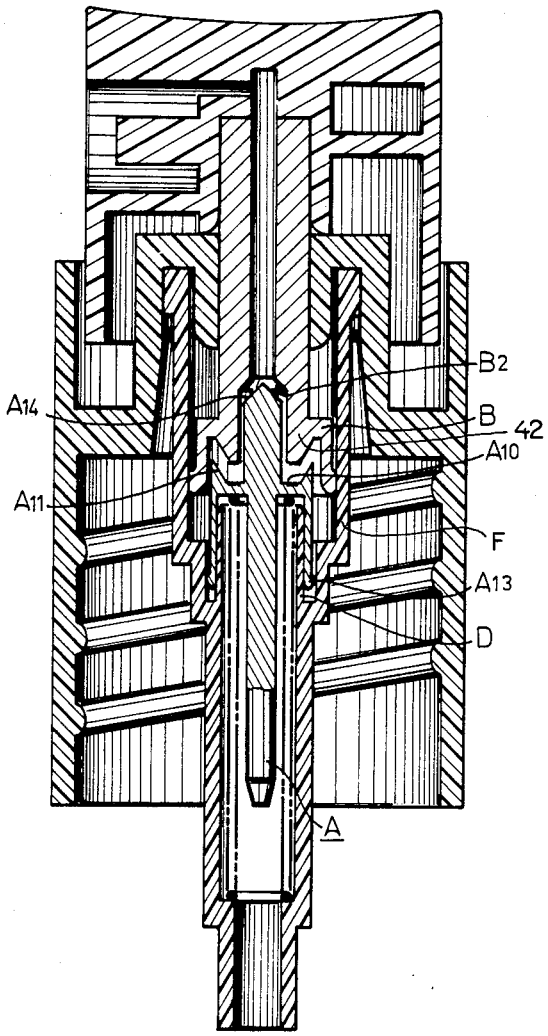
FIG. 3 is a similar view as shown in FIG. 2 wherein a moveable valve is forced to disengage from an opening of a piston body.

In use, firstly press an atomizer head (c) downward, and this in turn may drive the moveable valve body (A) downward such that the inner projection (A12) of the sleeve (A1) will move downward along the outer side of a valve seat (D) of cylindrical housing (F) to terminate the communication between the inside and the outside of the valve seat (D). At this instant, the sleeve (A1) continuously moves downward, therefore the liquid perfume contained in the outside of the valve seat (D) (namely the liquid perfume received in the inside of the piston body (B)) is compressed and the pressure generated by the pressurized liquid can only be applied to the flattened shoulder (A10) of the sleeve (A1). In this way, the downward force (which is generated by the pressurized liquid prefume) applied onto the flattened shoulder (A10) can certainly be larger than that applied onto the conventional tapered shoulder (211). In addition, the pressurized liquid can also be applied onto the outer projection (A13) of the sleeve (A1) to further help a valve area (A14) of the moveable valve body (A) to disengage from the opening (B2) of the piston body (B) so that the liquid perfume can be sprayed out from the perfume bottle, as shown in FIG. 3.

In view of the above, we can clearly see that the features of the present invention include the flattened shoulder (A10) of the sleeve (A1), the projection (A11) on the outer edge of the flattened shoulder (A10) and the outer projection (A13) on the lower end of the sleeve (A1). This arrangement can efficiently utilize the pressure generated by the pressurized liquid perfume to overcome the compression force provided by a spring (E). Therefore, it may facilitate the disengagement of the moveable valve body (A) from the piston body (B).

I claim:

1. A movable valve assembly for a liquid atomizer, comprising:

a piston body which includes a lip portion;

a cylindrical housing receiving a portion of said piston body; and a movable valve body received by a portion of said cylindrical housing and enclosed thereby, said valve body moved by said piston body within said housing, said movable valve body including a sleeve portion enclosed by said cylindrical housing, said sleeve portion including, a flattened shoulder receiving said lip portion of said piston assembly and forming a path for liquid flow therebetween, and a projection extending outwardly from said sleeve portion toward said cylindrical housing, said outward projection forming a sliding contact with said housing; wherein said flattened shoulder further includes a plurality of recesses or protruding ribs.

2. A movable valve assembly for a liquid atomizer, comprising:

a piston body which includes a U-shaped lip portion;

a cylindrical housing receiving a portion of said piston body;

a movable valve body received by a portion of said cylindrical housing and enclosed thereby, said valve body moved by said piston body within said housing, said movable valve body including a sleeve portion which includes, a flattened shoulder receiving said lip portion of said piston assembly and forming a path for liquid flow therebetween, a projection extending upwardly from the end of said shoulder, said upward projection, located adjacent said U-shaped lip portion of said piston body, wherein said flattened shoulder and said upward projection of said sleeve portion together form a U-shape which is complementary to said U-shaped lip portion, and a projection extending outwardly from said sleeve portion toward said cylindrical housing, said outward projection forming a sliding contact with said housing; and said cylindrical housing including a sleeve receiving portion which receives and is in sliding contact with said outward projection of said sleeve portion, whereby when said sleeve receiving portion receives said outward projection, liquid in said sleeve receiving portion in squeezed by said outward projection for flow out of the atomizer; wherein said flattened shoulder further includes a plurality of recesses or protruding ribs.

3. A movable valve assembly for a liquid atomizer, comprising:

a piston body which includes a U-shaped lip portion;

a cylindrical housing receiving a portion of said piston body;

a movable valve body received by a portion of said cylindrical housing and enclosed thereby, said valve body moving by said piston body within said housing, said movable valve body including a sleeve portion which includes, a flattened shoulder receiving said lip portion of said piston assembly and forming a path for liquid flow therebetween, a projection extending upwardly from the end of said shoulder, said upward projection located adjacent said U-shaped lip portion of said piston body, wherein said flattened shoulder and said upward projection of said sleeve portion together form a U-shape which is complementary to said U-shaped lip portion, and a projection extending outwardly from said sleeve portion toward said cylindrical housing, said outward projection forming a sliding contact with said housing; and said cylindrical housing including a sleeve receiving portion which receives and is in sliding contact with said outward projection of said sleeve portion, whereby when said sleeve receiving portion receives said outward projection, liquid in said sleeve receiving portion is squeezed by said outward projection for flow out of the atomizer;

wherein said piston body lip further includes a plurality of recesses or protruding ribs.

* * * * *